US006882320B2

(12) United States Patent
Park et al.

(10) Patent No.: US 6,882,320 B2
(45) Date of Patent: Apr. 19, 2005

(54) DIVERSITY ANTENNA APPARATUS FOR PORTABLE WIRELESS TERMINAL

(75) Inventors: Jong-Kui Park, Suwon-shi (KR); Dong-In Ha, Yongin-shi (KR); Krylov Konstantin, Suwon-shi (KR); Ju-Hyung Lee, Kwachon-shi (KR)

(73) Assignee: Samsung Electronics Co., Ltd. (KR)

( * ) Notice: Subject to any disclaimer, the term of this patent is extended or adjusted under 35 U.S.C. 154(b) by 38 days.

(21) Appl. No.: 10/648,537

(22) Filed: Aug. 25, 2003

(65) Prior Publication Data

US 2004/0095283 A1 May 20, 2004

(30) Foreign Application Priority Data

Nov. 15, 2002 (KR) ..... 10-2002-0071011

(51) Int. Cl.[7] ..... H01Q 1/24
(52) U.S. Cl. ..... 343/702
(58) Field of Search ..... 343/702, 725, 343/700 MS, 895; 455/89, 90

(56) References Cited

U.S. PATENT DOCUMENTS 5,649,306 A * 7/1997 Vannatta et al. ..... 455/575.7
6,307,920 B1 * 10/2001 Thomson et al. ..... 379/45
6,806,835 B1 * 10/2004 Iwai et al. ..... 343/702
2003/0137459 A1 * 7/2003 Kim et al. ..... 343/702

* cited by examiner

*Primary Examiner*—Wilson Lee
*Assistant Examiner*—Huedung X. Cao
(74) *Attorney, Agent, or Firm*—Dilworth & Barrese, LLP

(57) ABSTRACT

A diversity antenna apparatus for a portable wireless terminal is provided with a main body having a main board installed therein and a folder electrically connected to the main board by a flexible printed data cable so as to be rotatably opened from and closed into the main body. The antenna apparatus includes a first antenna protruding from first side of an upper end of the main body so as to perform a transmitting and receiving function and a second antenna installed on a second side of an upper end of the main board and separated from the first antenna so as to perform a diversity receiving function. The diversity antenna is separated from the antenna apparatus by a sufficient distance, thereby improving a diversity effect. Further, the diversity antenna is installed within a space in the main body of the terminal, thereby not requiring a structural change and being easily installed in the portable wireless terminal.

12 Claims, 7 Drawing Sheets

DIVERSITY ANTENNA APPARATUS FOR PORTABLE WIRELESS TERMINAL

PRIORITY

This application claims priority to an application entitled "DIVERSITY ANTENNA APPARATUS FOR PORTABLE WIRELESS TERMINAL", filed in the Korean Industrial Property Office on Nov. 15, 2002 and assigned Serial No. 2002-71011, the contents of which are hereby incorporated by reference.

BACKGROUND OF THE INVENTION

1. Field of the Invention

The present invention relates to a portable wireless terminal, and more particularly to an antenna apparatus for a portable wireless terminal.

2. Description of the Related Art

Recently, portable wireless terminals have been developed toward miniaturized, multi-functional, lightweight, and low power consumption characteristics. An antenna apparatus is an essential part of the portable wireless terminal, thereby determining a speech quality of the terminal.

Conventionally, the antenna apparatus for a portable wireless terminal includes the combination of a helical antenna and a whip antenna. The helical antenna operates alone in a standby mode or under good radio propagation environments, and the whip antenna is drawn out from a main body of the terminal and operates simultaneously with the helical antenna in a communication mode or under poor radio propagation environments. In the antenna apparatus, the helical antenna with a comparatively larger volume is fixed to an upper end of the main body of the terminal, and the whip antenna is installed in the main body of the terminal so as to be drawn into and out from the terminal when desired, thereby operating in a drawn-out state.

The portable wireless terminals are manufactured as several types, i.e., bar-type terminals, flip-type terminals, and folder-type terminals. In case of the folder-type terminal, a folder is rotatably closed into a main body in the standby mode, thereby having an advantage in terms of miniaturization. Further, the folder is rotatably opened from the main body in the communication mode, thereby assuring a sufficient distance between a transmitting unit and a receiving unit. Therefore, the folder-type terminal is mainly selected by users.

FIG. 1 is a perspective view of a conventional folder-type terminal 100. As shown in FIG. 1, the conventional folder-type terminal 100 comprises a main body 101 including a main board 103 installed therein, a folder 102 rotatably connected to the main body 101, and a hinge device (not shown) for rotatably connecting the folder 102 to the main body 101. The folder 102 is rotated about a hinge axis A, thereby being opened from and closed into the main body 101. An antenna apparatus 110 is installed on one side (i.e. a first side) of an upper end of the main body 101.

The antenna apparatus 110 includes an antenna housing 111 having a helical antenna (not shown) installed therein and fixed to one side of the upper end of the main body 101, and a whip antenna 113 drawn into and out from the main body 101 via the antenna housing 111. That is, the aforementioned antenna apparatus 110 includes the combination of the helical antenna (not shown) and the whip antenna 113.

The helical antenna accommodated by the antenna housing 111 is connected to the main board 103, thereby operating in a communication mode under good radio propagation environments or in a standby mode. In case the whip antenna 113 is drawn into the main body 101, the whip antenna 113 is electrically isolated from the main board 103. On the other hand, in case the whip antenna 113 is drawn out from the main body, the whip antenna 113 is electrically connected to the main board 103, thereby operating simultaneously with the helical antenna in a communication mode or under poor radio propagation environments.

In order to prevent a fading effect, the portable wireless terminal 100 may further include a diversity antenna 115*a* or 115*b* serving as an anti-fading antenna. Herein, the fading effect means a reduction of a signal quality or a transmission rate, due to a change of a radio wave transmission medium, diffraction propagation, or a phase difference generated when a radio wave transmitted from one point is received via more than two routes.

The diversity antenna 115*a* or 115*b* is typically installed on either the upper end of the main body 101 or a lower end of the main body 101, typically on a second side that is opposite from where the antenna housing 111 is fixed.

The portable wireless terminal 100 detects the optimum signal by combining signals received by each of the diversity antenna 115*a* or 115*b* and the antenna apparatus 110, thereby preventing the fading effect and improving the signal quality. As the diversity antenna 115*a* or 115*b* is separated from the antenna apparatus 110, the anti-fading effect is proportionately improved.

However, the conventional antenna apparatus for the portable wireless terminal is protruded from the main body of the terminal, thereby being difficult to carry and being easily broken if the terminal is dropped. Further, the protruding structure of the antenna apparatus from the main body of the portable wireless terminal limits the designing possibilities of the antenna apparatus and mobile terminal. Moreover, it is difficult to assure a sufficient space required to install the diversity antenna.

SUMMARY OF THE INVENTION

Therefore, the present invention has been made in view of the above problems, and it is an object of the present invention to provide an antenna apparatus for a portable wireless terminal, which is easily carried and prevented from being broken and/or damaged.

It is another object of the present invention to provide a diversity antenna for a portable wireless terminal having a sufficient installation space.

In accordance with one aspect of the present invention, the above and other objects can be accomplished by the provision of a diversity antenna apparatus for a portable wireless terminal provided with a main body having a main board installed therein and a folder electrically connected to the main board by a flexible printed data cable so as to be rotatably opened from and closed into the main body, comprising:

- a first antenna protruding from one side of an upper end of the main body so as to perform a transmitting and receiving function; and
- a second antenna installed on the other side of an upper end of the main board and separated from the first antenna so as to perform a diversity receiving function.

In accordance with another aspect of the present invention, there is provided a diversity antenna apparatus for a portable wireless terminal, comprising:

- a first antenna protruding from one side of an upper end of the terminal so as to perform a transmitting and receiving function; and a second antenna installed on a lower end of a main board installed within the terminal and separated from the first antenna so as to perform a diversity receiving function.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
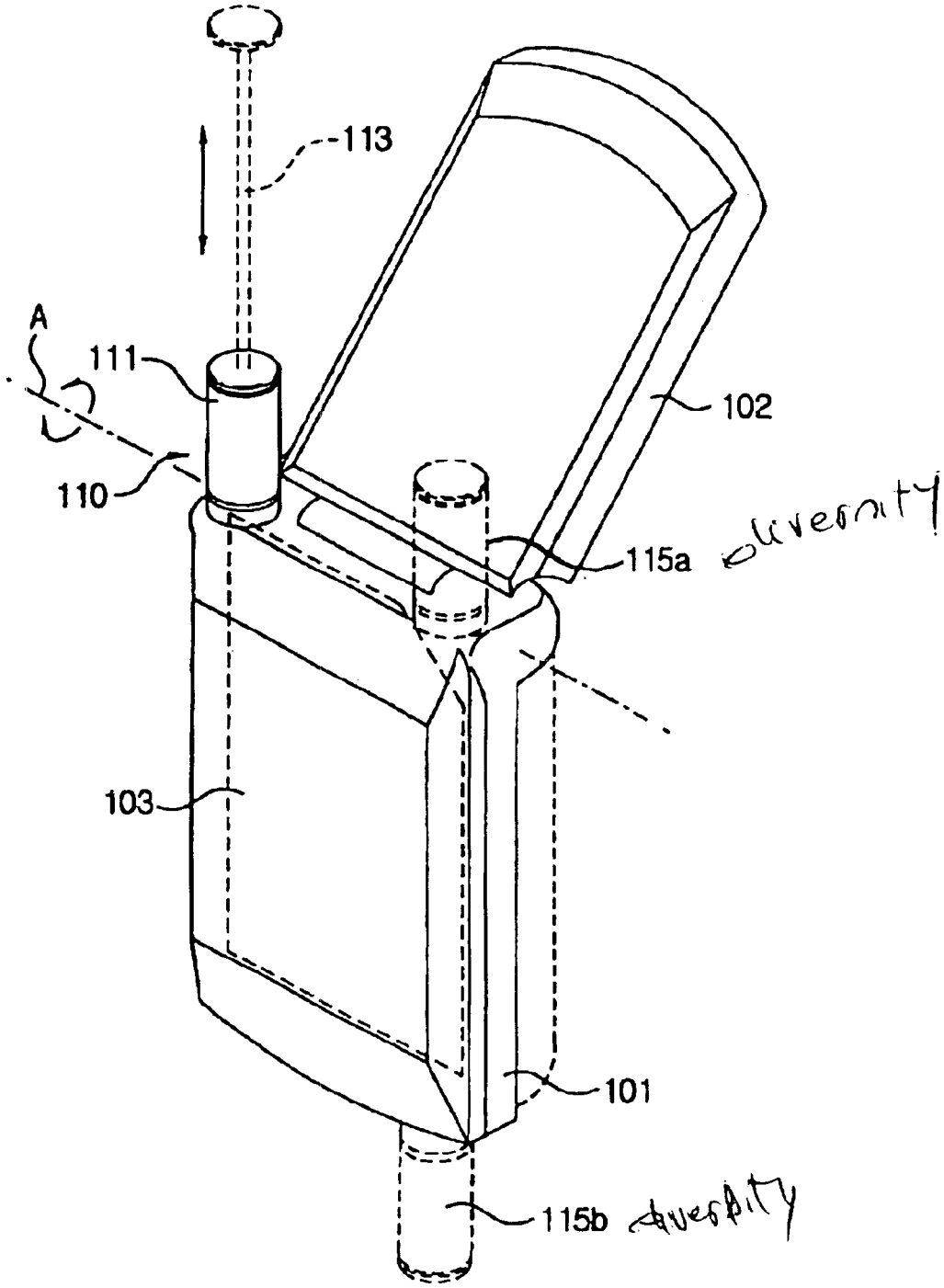
FIG. 1 (PRIOR ART)
FIG. 1 is a perspective view of a conventional portable wireless terminal.

Now, preferred embodiments of the present invention will be described in detail with reference to the annexed drawings. In the drawings, the same or similar elements are denoted by the same reference numerals even though they are depicted in different drawings. In the following description, a detailed description of known functions and configurations incorporated herein will be omitted to avoid making the subject matter of the present invention unclear.

Figure 2:
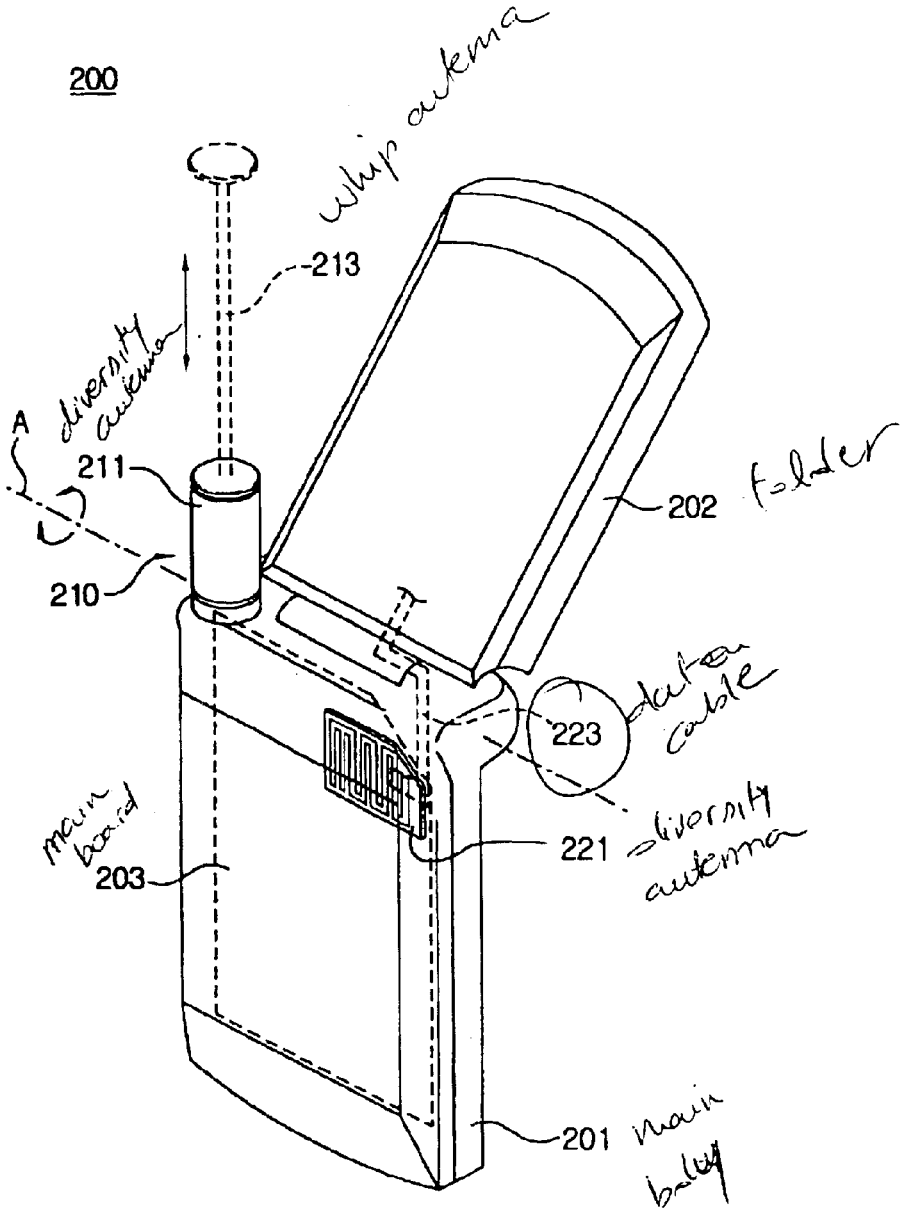
FIG. 2 is a perspective view of a portable wireless terminal employing a diversity antenna in accordance with a first preferred embodiment of the present invention.

FIG. 2 is a perspective view of a portable wireless terminal 200 employing a diversity antenna 221 in accordance with a first preferred embodiment of the present invention. As shown in FIG. 2, a diversity antenna 221 in accordance with the first preferred embodiment of the present invention is installed on one side of an upper portion of a main body 201 of the terminal 200.

The portable wireless terminal 200 is a folder-type terminal, and comprises the main body 201 including a main board 203 installed therein, a folder 202 rotatably connected to the main body 201, and a hinge device (not shown) for rotatably connecting the folder 202 to the main body 201. The folder 202 is rotated about a hinge axis A, thereby being opened from and closed into the main body 201. The portable wireless terminal 200 is provided with an antenna apparatus 210 installed on one side of an upper end of the main body 201, and a diversity antenna 221 installed within the main body 201 and on an other (second) side of the upper end of the main body 201 that is opposite to the one (first) side on which the antenna apparatus 210 is installed.

The antenna apparatus 210 includes an antenna housing 211 having a helical antenna (not shown) installed therein and being fixed to the one side of the upper end of the main body 201, and a whip antenna 213 drawn into and out from the main body 201 via the antenna housing 211. That is, the antenna apparatus 210 is formed by the combination of the helical antenna and the whip antenna 213.

The helical antenna accommodated within the antenna housing 211 is connected to the main board 203, thereby operating in a communication mode under good radio propagation environments or in a standby mode. In case the whip antenna 213 is drawn into the main body 201, the whip antenna 213 is electrically isolated from the main board 203, and in case the whip antenna 213 is drawn out from the main body 201, the whip antenna 213 is electrically connected to the main board 203, thereby operating simultaneously with the helical antenna under poor radio propagation environments.

Preferably, the diversity antenna 221 is affixed to, in a manner that preferably provides separation from, the main board 203 within the main body 201. The diversity antenna 221 is selected from antennas easily mounted in a narrow area within the main body 201 such as a PIFA (planar inverted-F antenna), a meander antenna, a loop antenna, an inverted-F antenna, and a wire type antenna. The aforementioned types of antennas are modified from an antenna comprising antenna patterns including a ground and a feeding point formed on a designated plane. Further, since the aforementioned types of antennas are separated from the main board 203 by a designated depth, there is no reduction of the radiation property due to resonance generated between the antenna and the main board and the absorption of radiated waves by the ground of the terminal. For example, the PIFA is installed such that a radiation plate is interposed between the main board 203 and a rear casing of the main body 201 or between the main board 203 and a front casing of the main body 201 so as to be separated from the main board 203 by a connection plate and a feeder pin. These types of antennas are easily installed in a narrow space within the terminal.

Hereinafter, various installation manners of the diversity antenna 221 are described in detail with reference to FIGS. 3 to 6.

Figure 3:
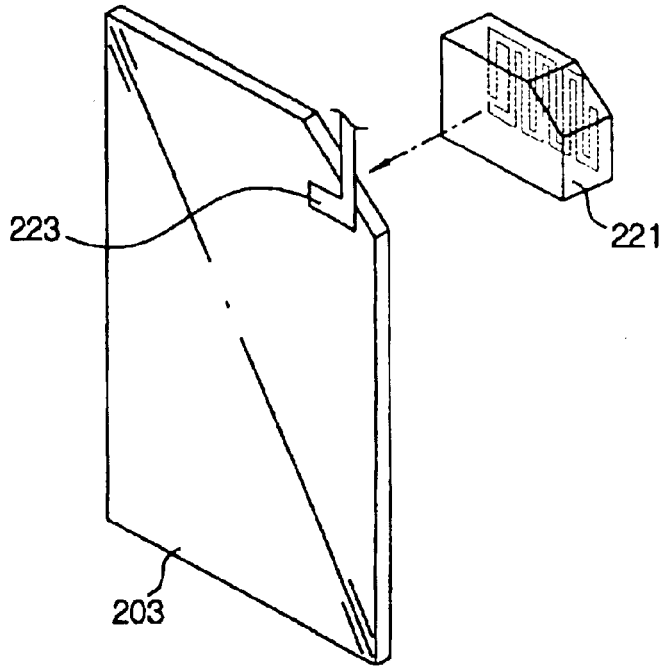
FIGS. 3 to 6 are internal perspective views showing installation manners of the diversity antenna of FIG. 2.
Figure 4:
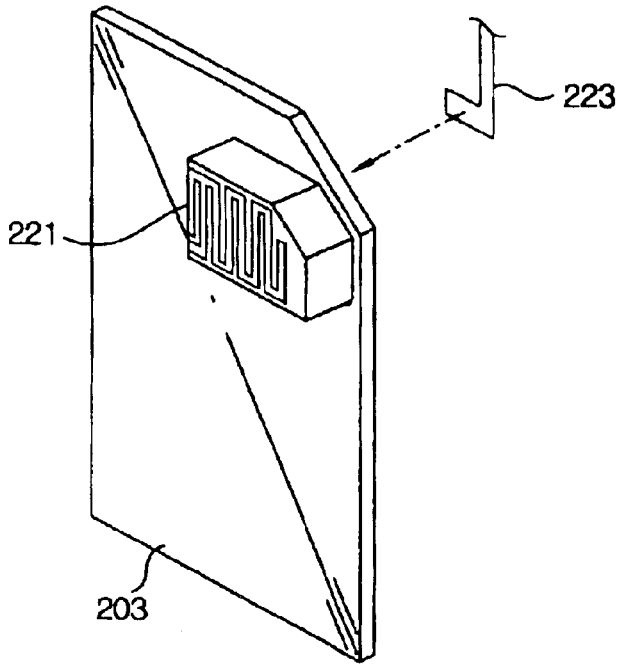

In FIG. 3, a flexible printed data cable 223 extended from the folder is connected to the front surface of one side of the upper end of the main board 203, and the diversity antenna 221 is installed on the rear surface of the main board 203. In FIG. 4, the flexible printed data cable 223 is connected to the rear surface of one side of the upper end of the main board 203, and the diversity antenna 221 is installed on the front surface of the main board 203. Herein, the diversity antenna 221 shown in FIGS. 3 and 4 is separated from the antenna apparatus 211 installed on the main body 201 by a designated distance, thereby achieving the optimum diversity effect.

Figure 5:
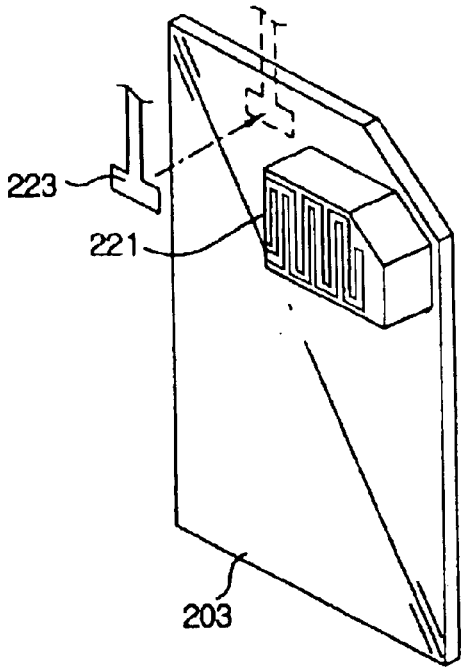

In FIG. 5, the flexible printed data cable 223 is connected to the center of the upper end of the main board 203 on the same surface as the surface of the main body 201 provided with the diversity antenna 221. Therefore, the diversity antenna 221 may be installed on either of both surfaces of the main board 203 regardless of the position of the flexible printed data cable 223.

Figure 6:
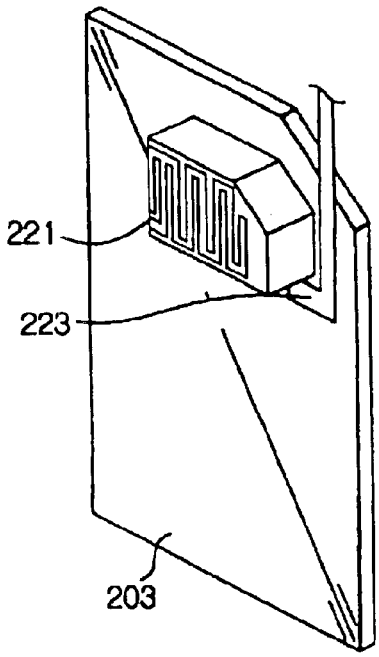

In FIG. 6, the flexible printed data cable 223 and the diversity antenna 221 are installed on the same surface of the main board 203. After the diversity antenna 221 is installed on one surface of the main board 203, the flexible printed data cable 223 is connected to the same surface of the main board 203 below the diversity antenna 221. Preferably, the flexible printed data cable 223 is separated from the diversity antenna 221. This prevents the reduction of radiation property due to the resonance with the flexible printed data cable 223 and the absorption of radiated wave by the ground.

Figure 7:
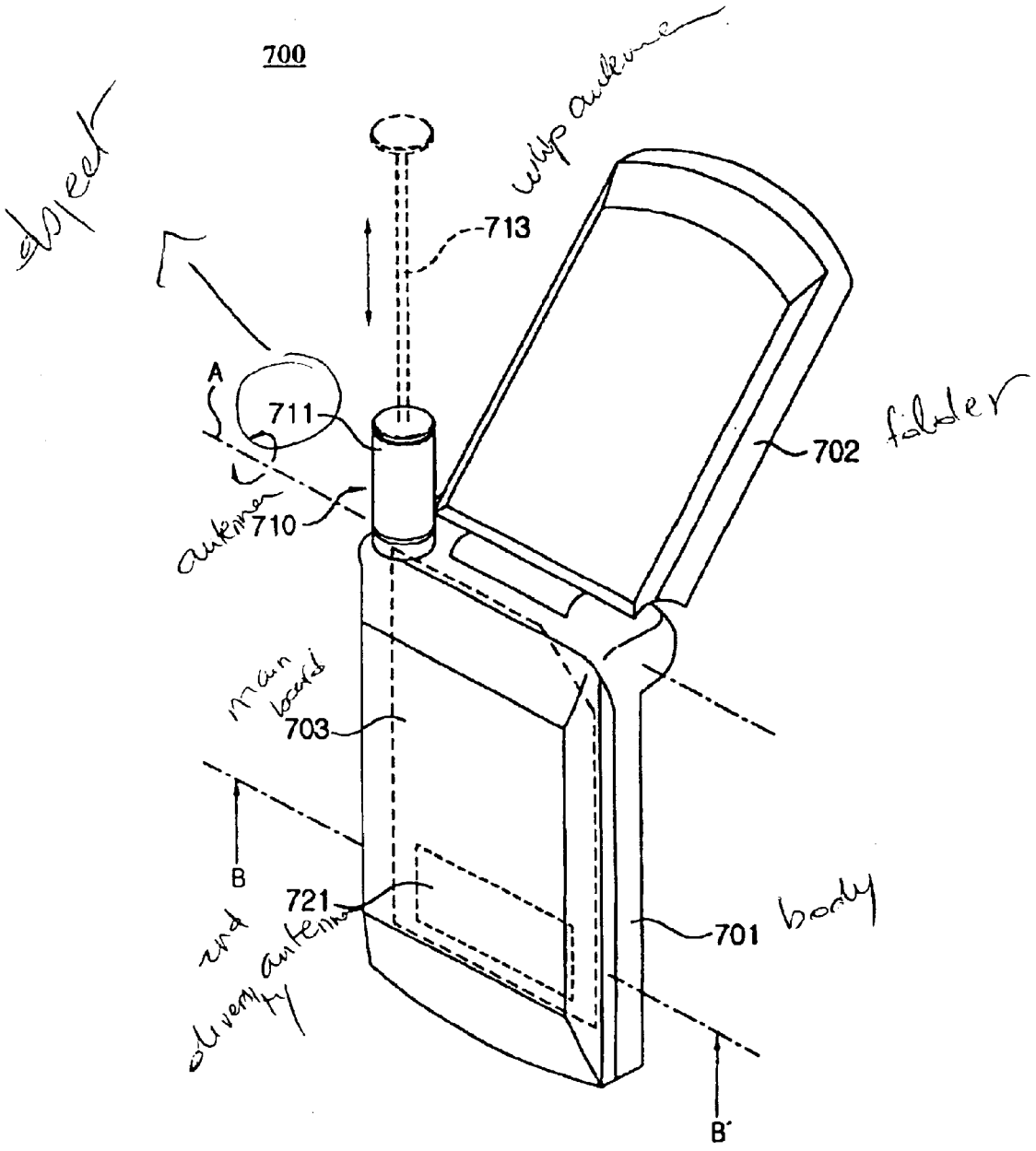
FIG. 7 is a perspective view of a portable wireless terminal employing a diversity antenna in accordance with a second preferred embodiment of the present invention.

FIG. 7 is a perspective view of a portable wireless terminal 700 employing a diversity antenna 721 in accordance with a second preferred embodiment of the present invention.

As shown in FIG. 7, the diversity antenna 721 of the second preferred embodiment of the present invention is installed in a lower end of a main body 701 of the terminal 700.

The portable wireless terminal 700 comprises the main body 701, a folder 702 rotatably connected to the main body 701 so as to be rotated about a hinge axis A, a first antenna 710, and the diversity (second) antenna 721.

The first antenna 710 is formed by the combination of a helical antenna (not shown) and a whip antenna 713, and is fixedly protruded from an upper end of the main body 701.

The second antenna 721 serving to perform a diversity function is installed on a lower portion of the main board 703 at a predetermined position toward the lower end of the main body 701 so as to be separated by the maximum distance from the first antenna 710. It will be appreciated to those skilled in the art that the second antenna 721 is installed on the lower end of the main board 703 or around an interface connector installed on the lower end of the main body 701.

The second antenna 721 is selected from antennas easily mounted in a narrow space within the main body 701, such as a PIFA (planar inverted-F antenna), a meander antenna, a loop antenna, an inverted-F antenna, and a wire type antenna.

Figure 8:
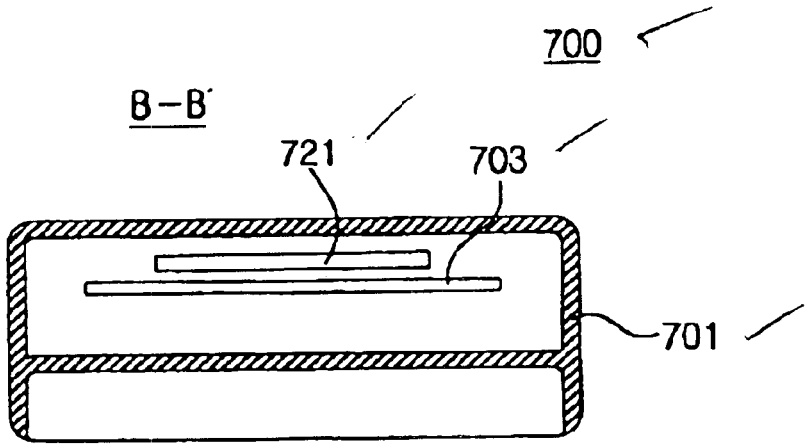
FIGS. 8 to 10 are cross-sectional views showing installation manners of the diversity antenna of FIG. 7.
Figure 9:
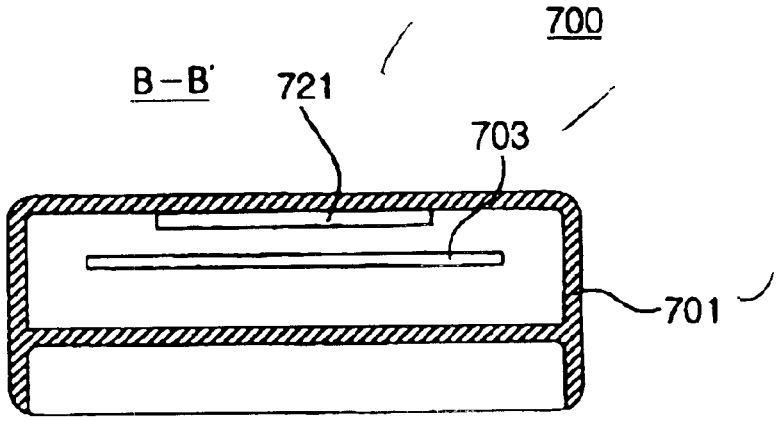
Figure 10:
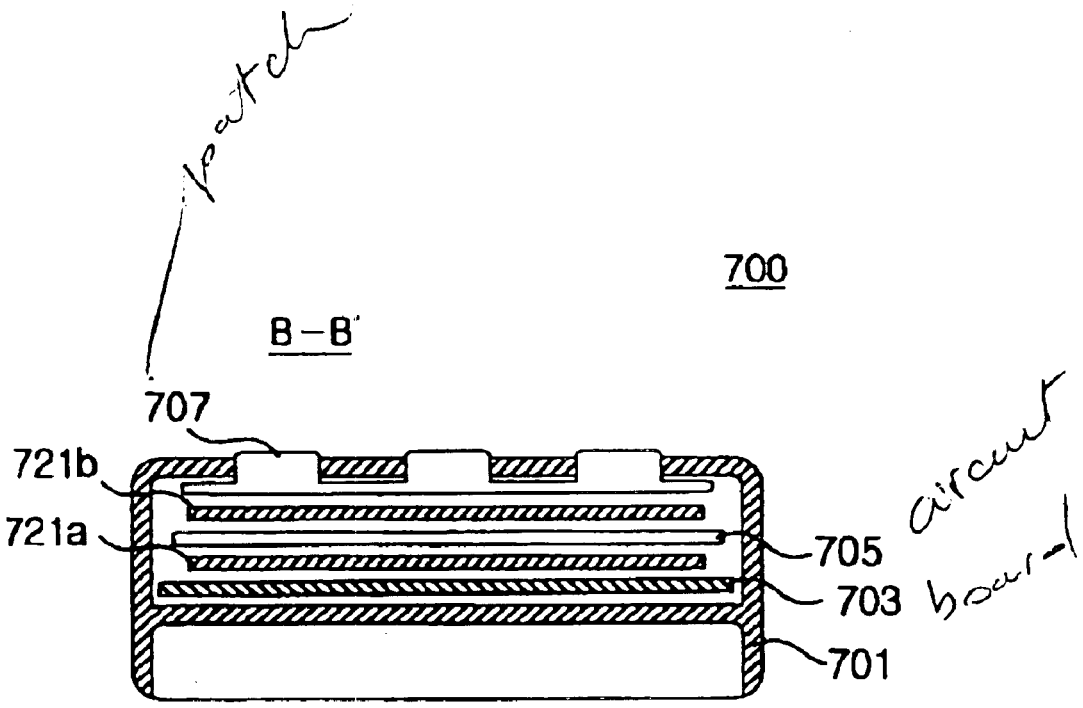

FIGS. 8 to 10 shows various installation manners of the diversity antenna 721 of FIG. 7, in cross-sectional views of the terminal 700 taken along the line B–B' of FIG. 7. As shown in FIGS. 8 and 9, the second antenna 721 is separated from the front surface of the main board 703 installed within the main body 701 by a designated depth, or installed on an inner wall of a front surface of the main body 701. Further, the second antenna 721 may be installed by forming antenna patterns on an inner wall of a silicon keypad (not shown) installed in the front surface of the main body 701.

In FIG. 10, the second antenna 721 is installed beyond the front surface of the main board 703, and includes a first antenna pad 721*a* and a second antenna pad 721*b*.

As shown in FIG. 10, a silicon keypad 707 is installed beyond the front surface of the main board 703 within the main body. Key buttons of the silicon keypad 707 protrude from the front surface of the main body of the terminal, thereby serving as means for inputting data by users. A flexible printed circuit 705 for a keypad, generating electrical signals through a dome switch by operating the silicon keypad 707, is installed between the silicon keypad 707 and the main board 703. The first antenna pad 721*a* and the second antenna pad 721*b* are respectively installed beyond the rear and front surfaces of the flexible printed circuit 705. That is, the first antenna pad 721*a* is interposed between the main board 703 and the flexible printed circuit 705, and the second antenna pad 721*b* is interposed between the flexible printed circuit 705 and the silicon keypad 707.

As described above, the first antenna is used as a main antenna apparatus, and the second antenna is used as a diversity antenna. However, if necessary, the second antenna may be used as a main antenna apparatus, and the first antenna may be used as a diversity antenna.

As apparent from the above description, the present invention provides a diversity antenna for a portable wireless terminal, separated from a main antenna apparatus by a sufficient distance, thereby improving a diversity effect. Further, the diversity antenna of the present invention is installed within a space in the main body of the terminal, thereby not requiring a structural change and being easily installed in the portable wireless terminal.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A diversity antenna apparatus for a portable wireless terminal provided with a main body having a main board installed therein and a folder electrically connected to the main board by a flexible printed data cable so as to be rotatably opened from and closed into the main body, comprising:

a first antenna protruding from an upper end of the main body on a first side of the terminal so as to perform a transmitting and receiving function; and a second antenna installed on an upper end of the main board on a second side of the terminal and separated from the first antenna so as to perform a diversity receiving function.

2. The diversity antenna apparatus for a portable wireless terminal as set forth in claim 1, wherein the flexible printed data cable is connected to a front surface of the main board, and the second antenna is installed on a rear surface of the main board.

3. The diversity antenna apparatus for a portable wireless terminal as set forth in claim 1, wherein the flexible printed data cable is connected to a rear surface of the main board, and the second antenna is installed on a front surface of the main board.

4. The diversity antenna apparatus for a portable wireless terminal as set forth in claim 1, wherein the flexible printed data cable is connected to a center of a front surface of the main board.

5. The diversity antenna apparatus for a portable wireless terminal as set forth in claim 1, wherein the flexible printed data cable is connected to the main board below the second antenna with respect to the upper end.

6. The diversity antenna apparatus for a portable wireless terminal as set forth in claim 1, wherein the second antenna is installed on the main board and separated from the main board by a designated depth.

7. The diversity antenna apparatus for a portable wireless terminal as set forth in claim 1, wherein the second antenna is selected from the group consisting of a PIFA (planar inverted-F antenna), a meander antenna, a loop antenna, an inverted-F antenna, and a wire type antenna.

8. A diversity antenna apparatus for a portable wireless terminal, comprising:

a first antenna protruding from one side of an upper end of the terminal so as to perform a transmitting and receiving function; and a second antenna installed in a lower end of the terminal on a lower portion of a main board installed within the terminal and separated from the first antenna so as to perform a diversity receiving function.

9. The diversity antenna apparatus for a portable wireless terminal as set forth in claim 8, wherein the second antenna is separated from a front surface of the main board by a designated depth.

10. The diversity antenna apparatus for a portable wireless terminal as set forth in claim 8, wherein the second antenna is installed adjacent to an inner wall of a front casing of the terminal.

11. The diversity antenna apparatus for a portable wireless terminal as set forth in claim 8, wherein the second antenna is selected from the group consisting of a PIFA (planar inverted-F antenna), a meander antenna, a loop antenna, an inverted-F antenna, and a wire type antenna.

12. The diversity antenna apparatus for a portable wireless terminal as set forth in claim 8, wherein the portable wireless terminal includes:

a silicon keypad having a plurality of key buttons protruding from a front surface of the terminal; and a flexible printed circuit for the keypad, interposed between the silicon keypad and the main board, wherein the second antenna comprises first and second antenna pads, wherein the first antenna pad is interposed between the flexible printed circuit of the keypad and the main board, and the second antenna pad is interposed between the flexible printed circuit of the keypad and the key buttons of the silicon keypad.

* * * * *